US010944229B2

(12) United States Patent
Su

(10) Patent No.: US 10,944,229 B2
(45) Date of Patent: Mar. 9, 2021

(54) ELECTRICAL CONNECTOR HAVING A ROW OF CONTACTS MADE FROM TWO CONTACT CARRIERS OF DIFFERENT THICKNESS AND METHOD OF MAKING SAME

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Jie Su, Huaian (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/599,122

(22) Filed: Oct. 11, 2019

(65) Prior Publication Data

US 2020/0119509 A1 Apr. 16, 2020

(30) Foreign Application Priority Data

Oct. 12, 2018 (CN) ..... 2018 1 1188966

(51) Int. Cl.
*H01R 43/24* (2006.01)
*H01R 13/6585* (2011.01)
(Continued)

(52) U.S. Cl.
CPC ..... *H01R 43/24* (2013.01); *H01R 13/405* (2013.01); *H01R 13/502* (2013.01);
(Continued)

(58) Field of Classification Search
CPC .... H01R 43/24; H01R 13/405; H01R 13/502; H01R 13/6585
(Continued)

(56) References Cited

U.S. PATENT DOCUMENTS 9,647,387 B1 * 5/2017 Gou ..... H01R 24/60
9,893,473 B2 * 2/2018 Kong ..... H01R 13/652
(Continued)

FOREIGN PATENT DOCUMENTS

CN 204103121 U 1/2015
CN 105305132 A 2/2016
(Continued)

*Primary Examiner* — Alexander Gilman
(74) *Attorney, Agent, or Firm* — Wei Te Chung; Ming Chieh Chang

(57) ABSTRACT

An electrical connector includes: an insulative housing having a front tongue with two opposite surfaces; and a first and second rows of contacts with contacting portions exposed to the two opposite surfaces of the tongue; wherein the first row of contacts include a row of contacts from a first contact carrier of a first thickness and a row of contacts from a second contact carrier of a second thickness less than the first thickness; and the row of contacts from the first contact carrier and the row of contacts from the second contact carrier are molded to form the first row of contacts. A method of making a contact module of the electrical connector is characterized by molding the row of contacts from the first thicker contact carrier and the row of contacts from the second thinner contact carrier to form the first row of contacts.

17 Claims, 23 Drawing Sheets

(51) Int. Cl.
*H01R 13/502* (2006.01)
*H01R 13/405* (2006.01)
*H01R 107/00* (2006.01)
*H01R 24/60* (2011.01)

(52) U.S. Cl.
CPC ..... *H01R 13/6585* (2013.01); *H01R 24/60* (2013.01); *H01R 2107/00* (2013.01)

(58) Field of Classification Search
USPC ..... 439/607.08
See application file for complete search history.

(56) References Cited

U.S. PATENT DOCUMENTS 9,954,317 B2 * 4/2018 Zhao ..... H01R 13/516
10,312,635 B2 * 6/2019 Zhao ..... H01R 13/03
10,333,253 B2 * 6/2019 Zhao ..... H01R 13/631
10,468,825 B2 * 11/2019 Zhao ..... H01R 13/6585
2002/0127896 A1 * 9/2002 Lomastro ..... H01R 9/2483 439/108
2008/0176448 A1 * 7/2008 Muller ..... H01R 13/6593 439/607.01
2010/0173524 A1 * 7/2010 Zhu ..... H01R 24/62 439/607.01
2011/0159733 A1 * 6/2011 Wang ..... H01R 12/707 439/607.01
2012/0009818 A1 * 1/2012 Yao ..... H01R 24/62 439/607.23
2015/0004835 A1 * 1/2015 Allwood ..... H01R 24/60 439/607.25
2015/0072557 A1 * 3/2015 Kamei ..... H01R 43/00 439/607.02
2015/0171563 A1 * 6/2015 Reinhardt ..... H01R 13/6581 439/357
2016/0141806 A1 * 5/2016 Guo ..... H01R 13/6594 439/607.01
2017/0077652 A1 * 3/2017 Chen ..... H01R 24/60
2017/0279235 A1 * 9/2017 Tada ..... H01R 13/6581
2018/0006408 A1 * 1/2018 Wen ..... H01R 24/62
2018/0109042 A1 * 4/2018 Little ..... H01R 13/6585
2019/0115678 A1 * 4/2019 Zhao ..... H01R 13/6471
2019/0237912 A1 * 8/2019 Little ..... H01R 13/6585
2019/0252830 A1 * 8/2019 Zhao ..... H01R 13/6585
2020/0119509 A1 * 4/2020 Su ..... H01R 43/24
2020/0136291 A1 * 4/2020 Zhao ..... H01R 43/16
2020/0136293 A1 * 4/2020 Zhao ..... H01R 13/504

FOREIGN PATENT DOCUMENTS

CN 205122849 U 3/2016
CN 107204527 A 9/2017

* cited by examiner

ELECTRICAL CONNECTOR HAVING A ROW OF CONTACTS MADE FROM TWO CONTACT CARRIERS OF DIFFERENT THICKNESS AND METHOD OF MAKING SAME

BACKGROUND OF THE INVENTION

1. Field of the Invention

The present invention relates to an electrical connector including an insulative housing having a front tongue with two opposite surfaces and a first and second rows of contacts with contacting portions exposed to the two opposite surfaces of the tongue, wherein at least one of the first and second rows of contacts includes a group of contacts from a first contact carrier of a first thickness and a group of contacts from a second contact carrier which are assembled in a molding operation to form the first row of contacts.

2. Description of Related Arts

China Patent No. 105305132 discloses an electrical connector, including an insulative housing having a front tongue with two opposite surfaces, a first and second rows of contacts with contacting portions exposed to the two opposite surfaces of the tongue, and a middle shielding plate between the two rows of contacts, wherein each row of contacts are made from a same contact carrier and one row of contacts and the middle shielding plate are molded while the other row of contacts are mounted to the molded unit for subsequent further molding operation.

SUMMARY OF THE INVENTION

An electrical connector comprises: an insulative housing having a front tongue with two opposite surfaces; and a first and second rows of contacts with contacting portions exposed to the two opposite surfaces of the tongue; wherein the first row of contacts include a row of contacts from a first contact carrier of a first thickness and a row of contacts from a second contact carrier of a second thickness less than the first thickness; and the row of contacts from the first contact carrier and the row of contacts from the second contact carrier are molded to form the first row of contacts. A method of making a contact module of the electrical connector is characterized by the steps of: forming a row of contacts from a first contact carrier of a first thickness; forming a row of contacts from a second contact carrier of a second thickness less than the first thickness; and molding the row of contacts from the first contact carrier and the row of contacts from the second contact carrier to form the first row of contacts.

BRIEF DESCRIPTION OF THE DRAWING

FIG. 13 (A) is another cross-sectional view of the electrical connector taken along line 13-13 in FIG. 1;

DETAILED DESCRIPTION OF THE PREFERRED EMBODIMENT

Figure 1:
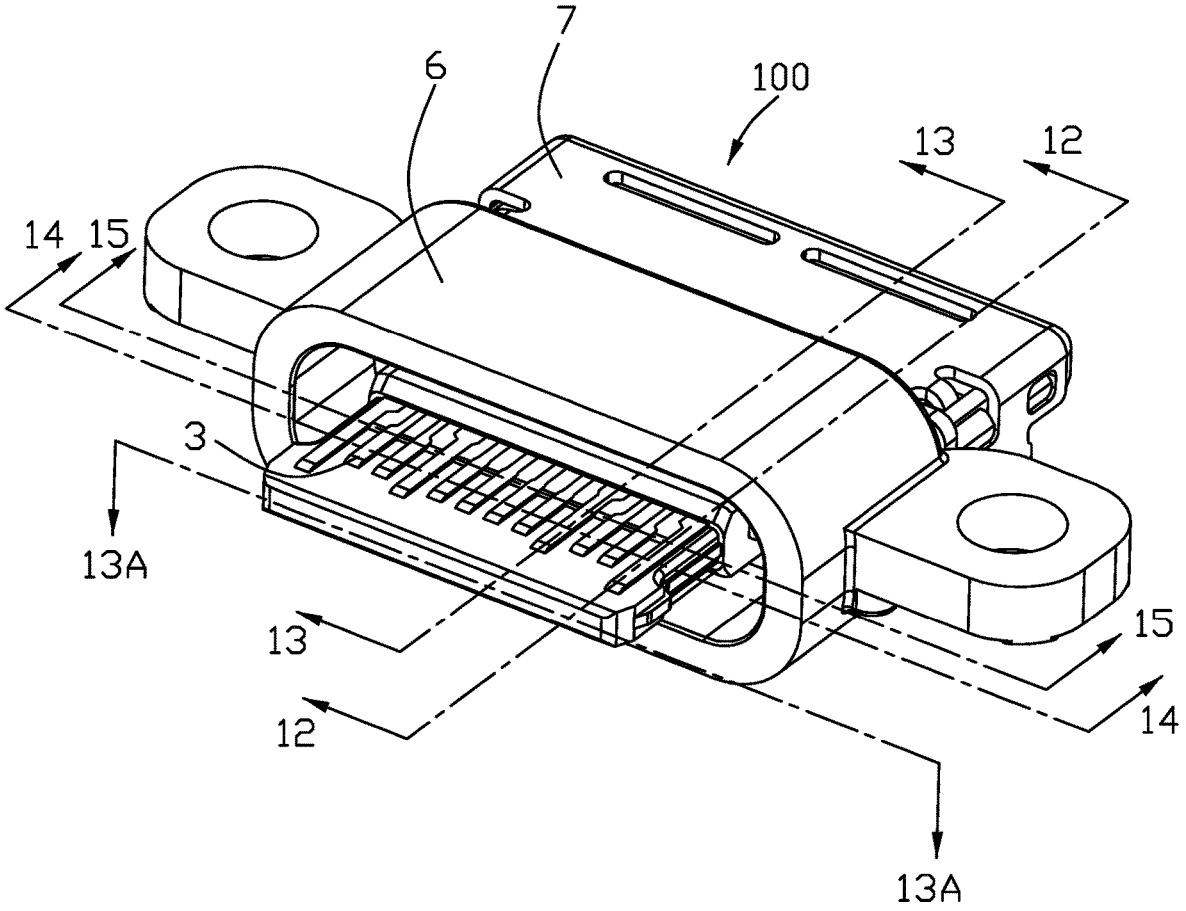
FIG. 1 is a perspective view of an electrical connector in accordance with the present invention.
Figure 2:
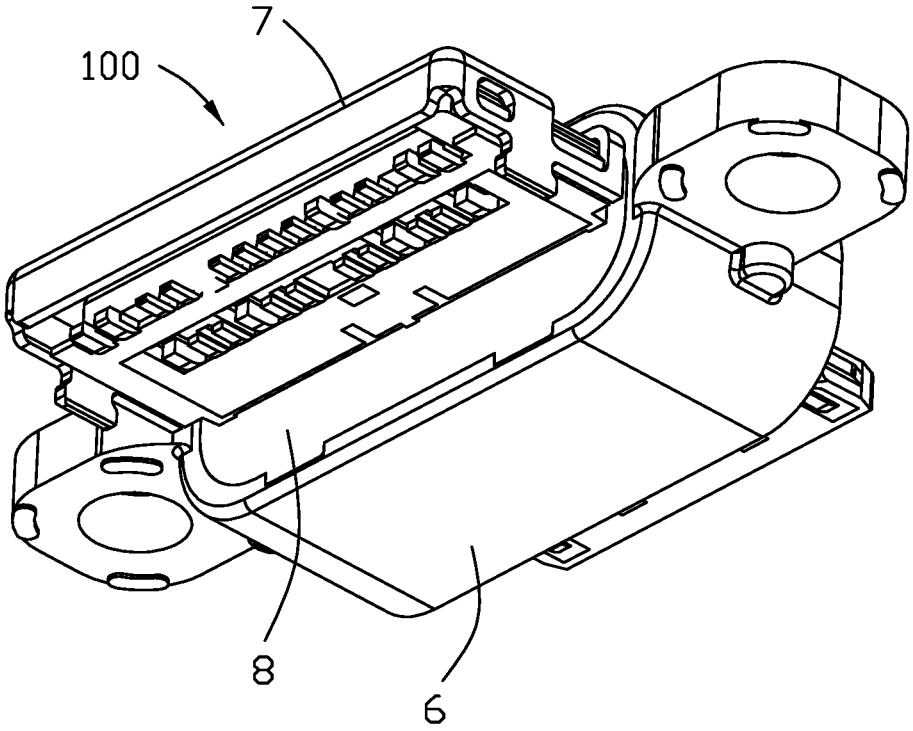
FIG. 2 is a perspective view of the electrical connector from another perspective.
Figure 3:
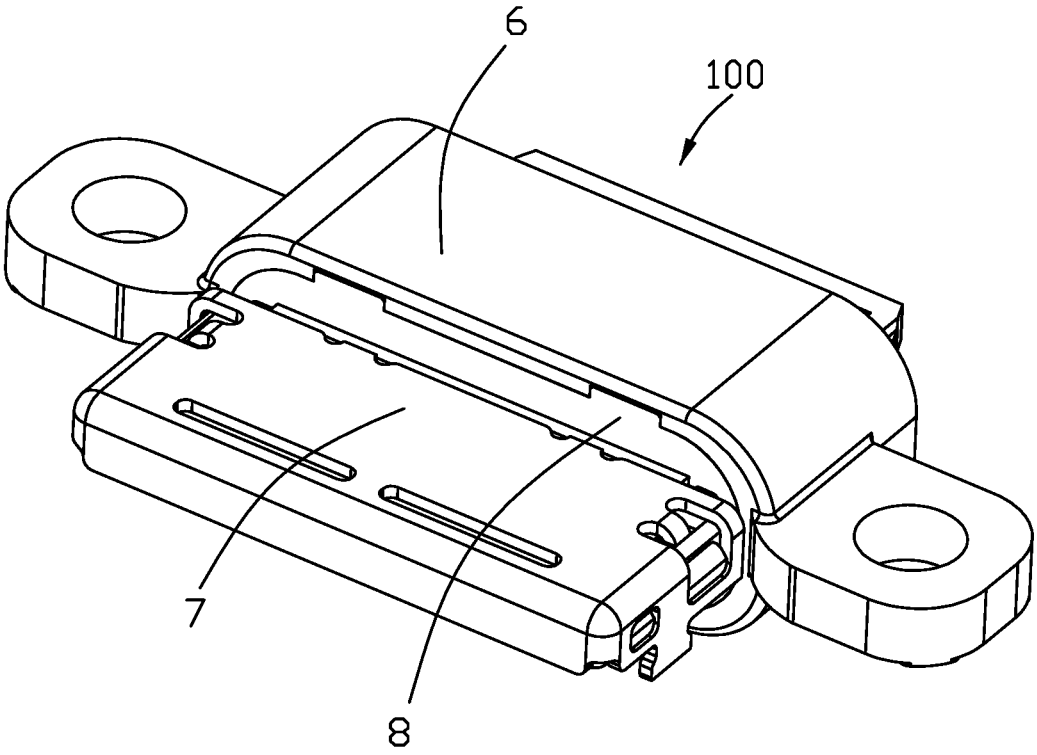
FIG. 3 is a perspective view of the electrical connector from yet another perspective.

Referring to FIGS. 1-11, an electrical connector 100 in accordance with the present invention comprises an insulative housing 1 consisting of a first insulator 11 and a second insulator 12, and a first and second rows of contacts 2 and 3 secured in the insulative housing 1. The electrical connector 100 may further comprise a middle shielding plate 4, a grounding ring 5, a plastic cover 6, a rear shell 7, and a rear sealing member 8. In this embodiment, the combination of the insulative housing associated with the contacts 2 and 3 and the shielding plate 4, is called as the contact module.

Figure 10:
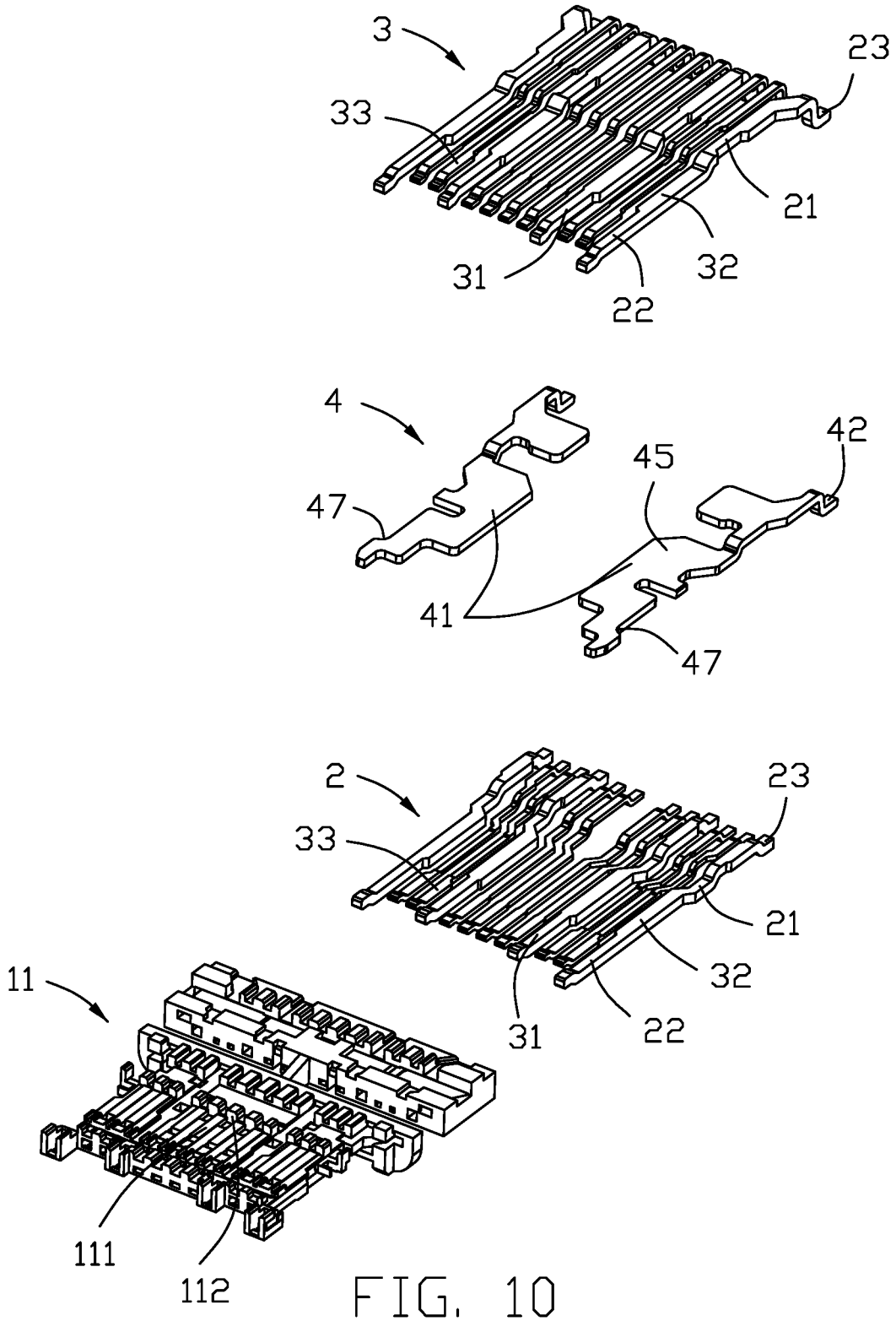
FIG. 10 is an exploded view of a first insulator of the insulative housing, the first and second rows of contacts, and the middle shielding plate.
Figure 11:
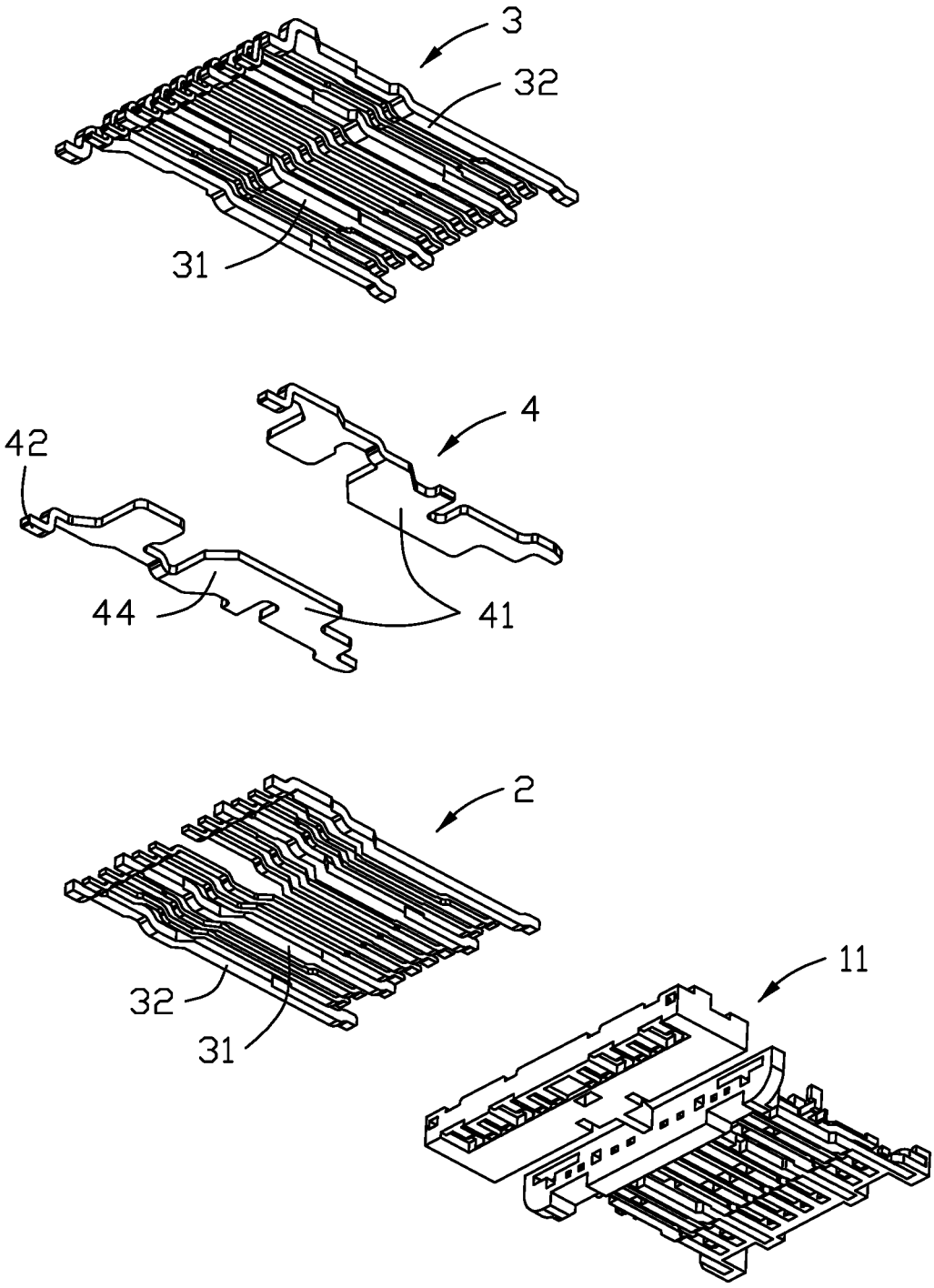
FIG. 11 is a view similar to FIG. 10 but from another perspective.
Figure 12:
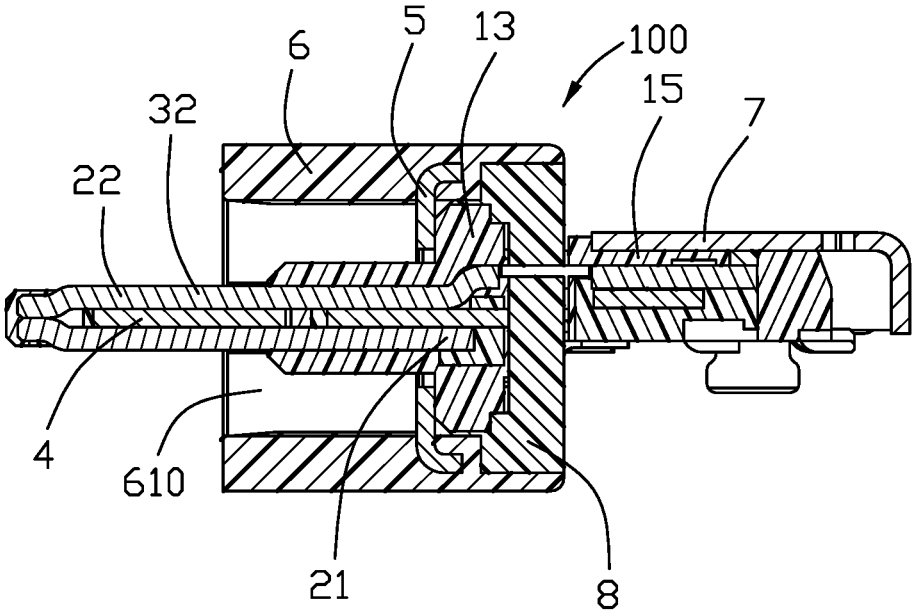
FIG. 12 is a cross-sectional view of the electrical connector taken along line 12-12 in FIG. 1.
Figure 16:
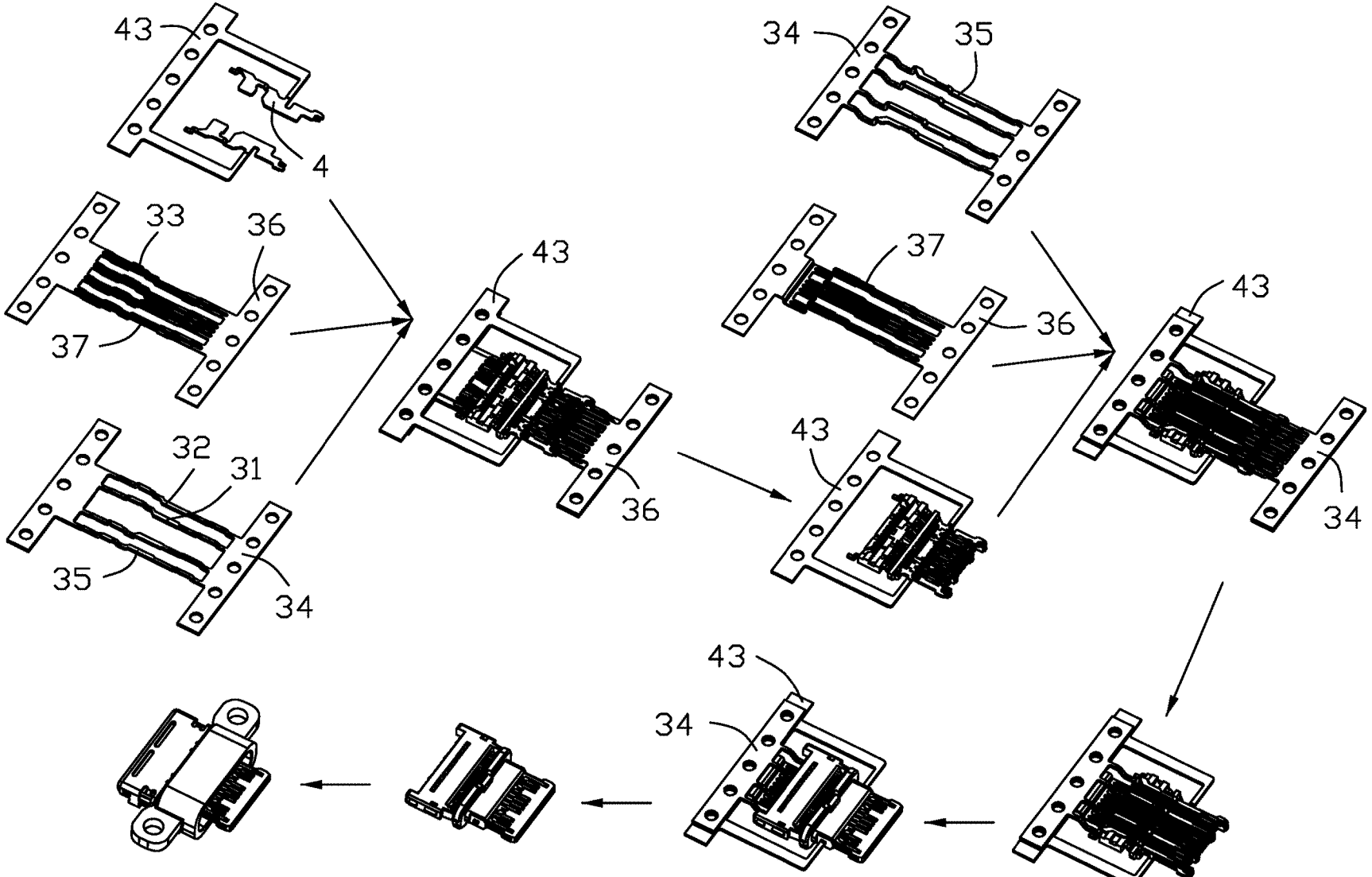
FIG. 16 schematically shows operation steps of the electrical connector.
Figure 17:
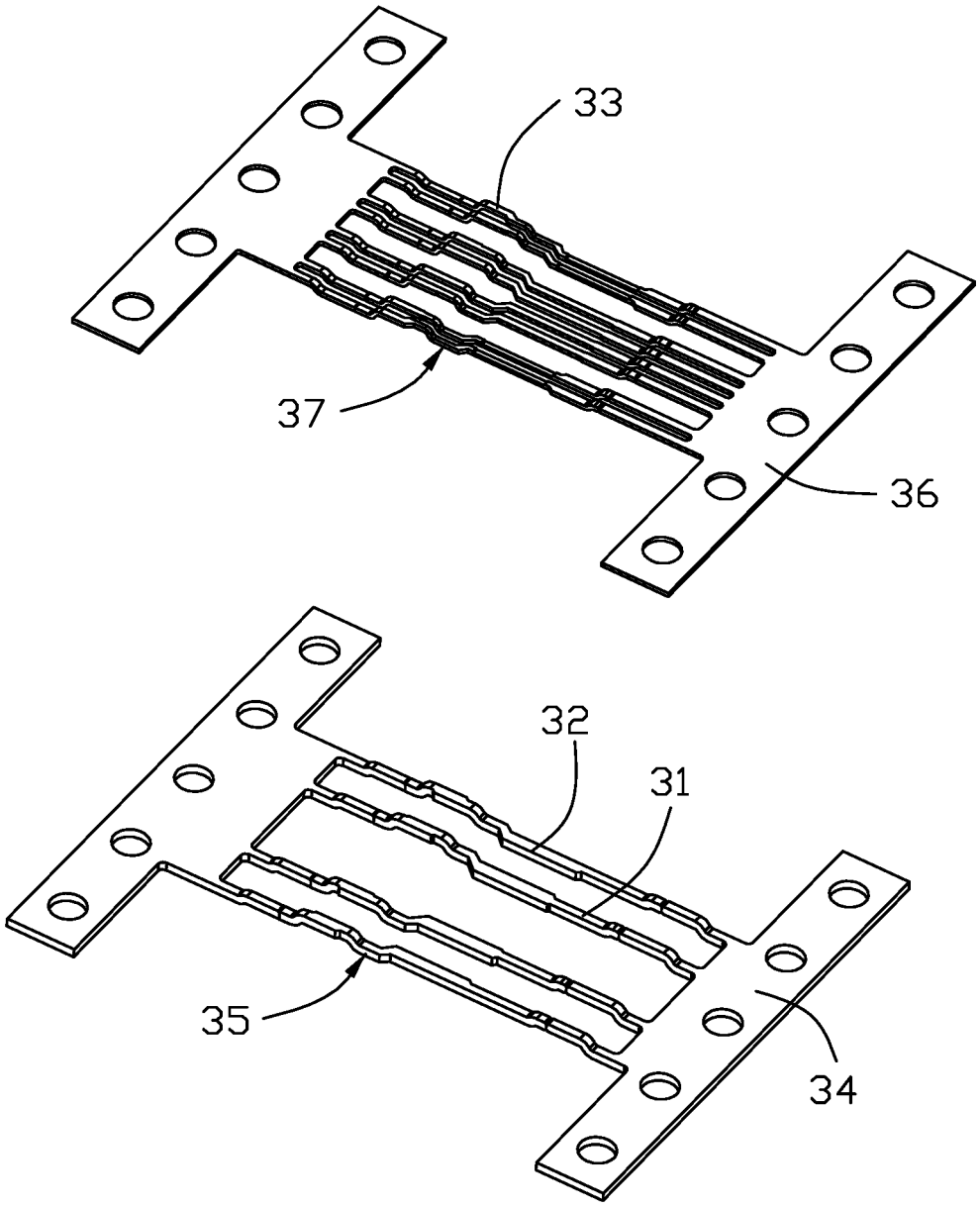
FIG. 17 shows a row of contacts from a first contact carrier and a row of contacts from a second contact carrier in a separated state.

Referring to FIGS. 10-11 and 16, each of the first lower row of contacts 2 and the second upper row of contacts 3 has securing portion 21, a front contacting portion 22, and a rear soldering portion 23. Each row of contacts 2 or 3 include power contacts 31 and ground contacts 32 both of a first thickness and signal contacts 33 of a second thickness. During manufacturing, the power and ground contacts 31 and 32 are formed from a first contact carrier 34 as a first group 35; the signal contacts 33 are formed from a second contact carrier 36 as a second group 37. The second thickness, e.g., 0.09-0.13 mm, is less than the first thickness, e.g., 0.14-0.26 mm.

The shielding plate 4 is constructed as two separate pieces each including a main part 41, a soldering leg 42, and a notch 47. During manufacturing, the shielding plate 4 is connected with a third or middle carrier 43.

During manufacturing, the first contact carrier 34 carrying the first group of contacts 35, the second contact carrier 36 carrying the second group of contacts 37, and the third carrier 43 carrying the shielding plate 4 are stacked and aligned so that a first surface 44 of the shielding plate 4 contacts a corresponding ground contact 32 of the first row of contacts 2, which then is insert molded with a first insulator 11. A second surface 45 of the shielding plate 4 is exposed to an upper surface of the first insulator 11. Plural grooves 111 dividers 112 are formed on the upper surface of the first insulator 11.

Subsequently, the first and second contact carriers 34 and 36 are severed, leaving only the third carrier 43 connected to the shielding plate 4.

Figure 8:
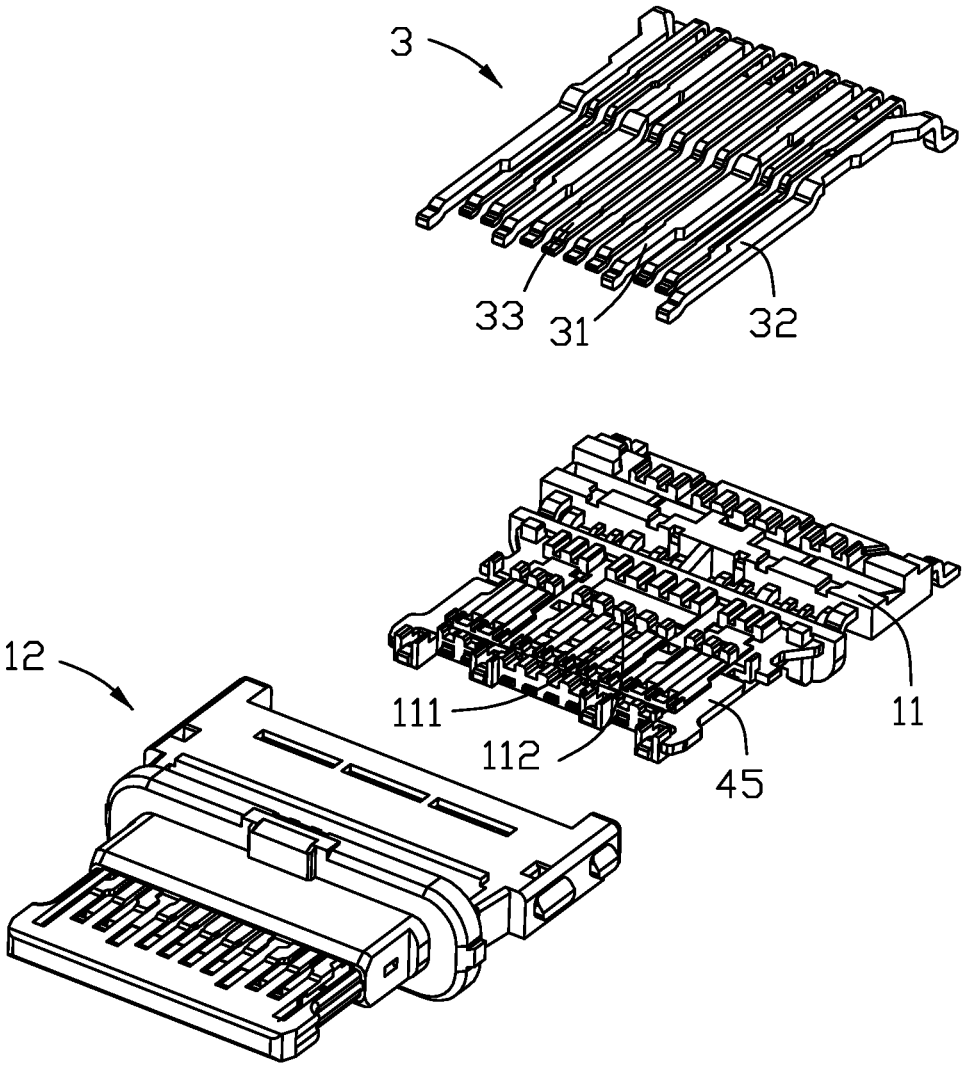
FIG. 8 is a further exploded view of FIG. 6.
Figure 9:
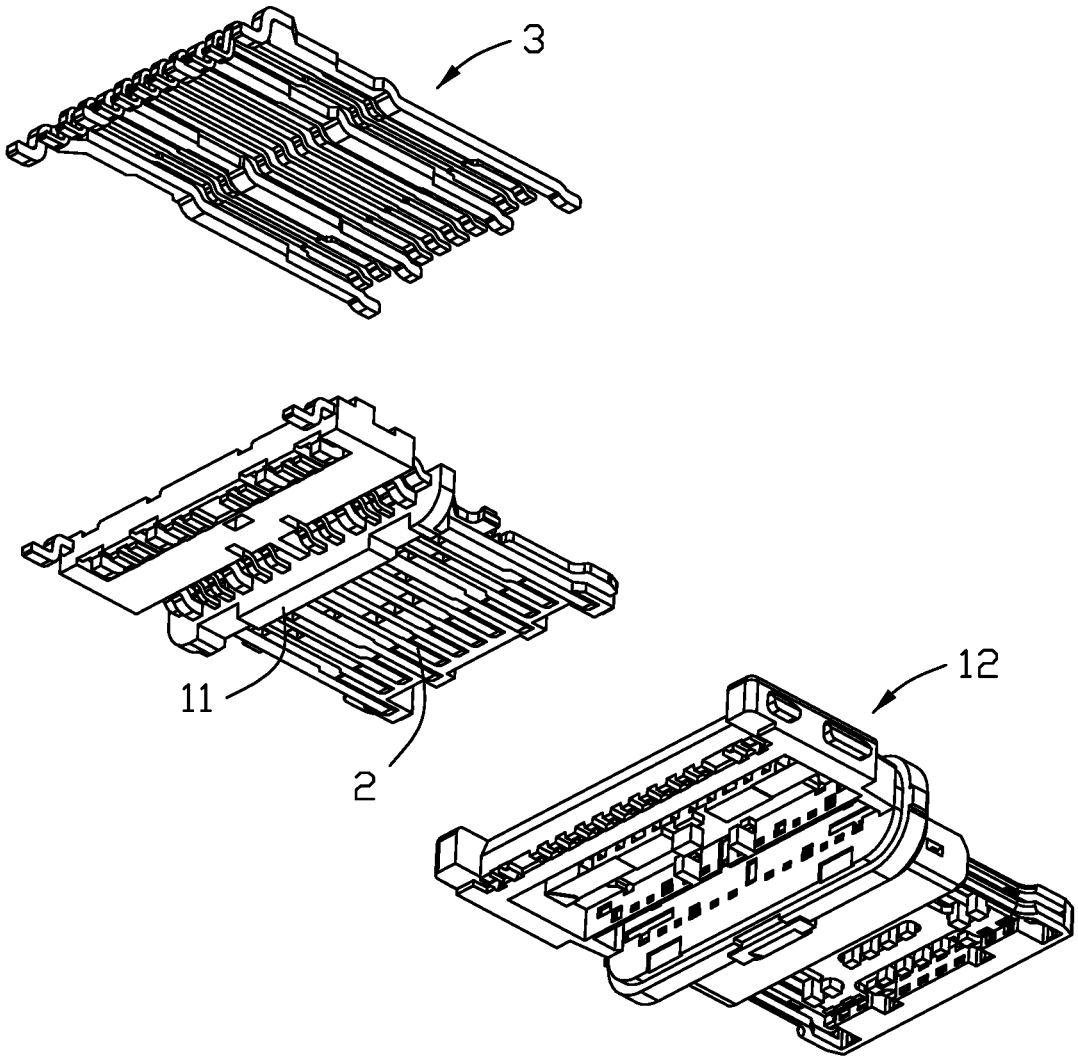
FIG. 9 is a further exploded view of FIG. 7.

Referring to FIGS. 8-9 and 16, another first contact carrier 34 carrying the first group of contacts 35 and another second contact carrier 36 carrying the second group of contacts 37, to form the second row of contacts 3, are stacked and the contacts are mounted to corresponding grooves 111 where a corresponding ground contact 32 of the second row of contacts 3 contacts the exposed surface 45 of the shielding plate 4.

Subsequently, respective front parts of the first and second contact carriers 34 and 36 are severed, with respective rear parts thereof and the third carrier 43 still connected.

In the contact module or assembly made so far, referring also to FIGS. 12-15, the shielding plate 4 is in contact with corresponding ground contacts 32 in both the first and second rows of contacts while it is far away from the power contacts 31. In addition, front ends of corresponding ground contacts 32 in both rows of contacts are bent to contact each other, so are front ends of corresponding power contacts 31 contact each other to conduct large current. Also, each contact is generally of uniform thickness throughout.

Figure 6:
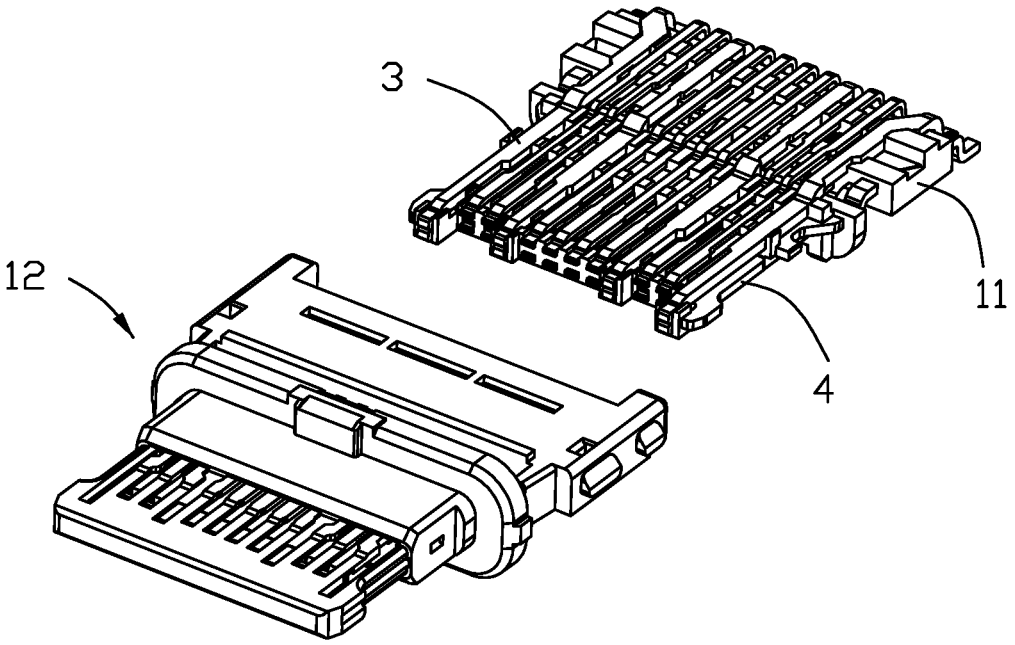
FIG. 6 is an exploded view of an insulative housing, a first and second rows of contacts, and a middle shielding plate of the electrical connector.
Figure 7:
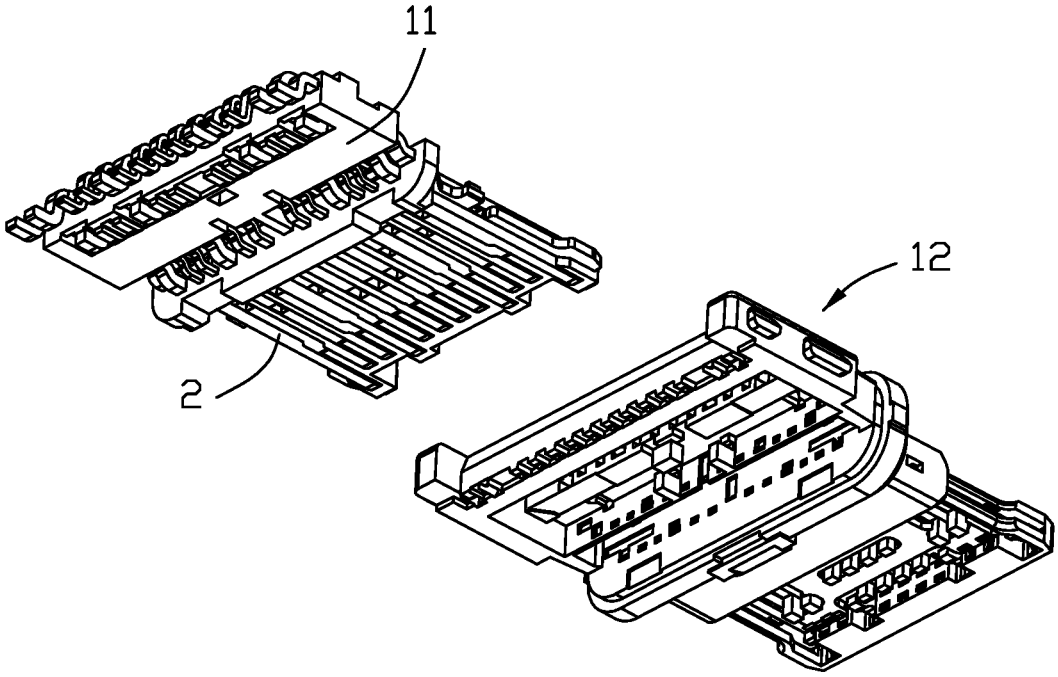
FIG. 7 is a view similar to FIG. 6 but from another perspective.

Referring to FIGS. 6-7 and 16, a second insulator 12 is over-molded to the assembly, and the third carrier 43 and respective rear parts of the first and second contact carriers 34 and 36 are severed, sequentially or simultaneously.

Figure 4:
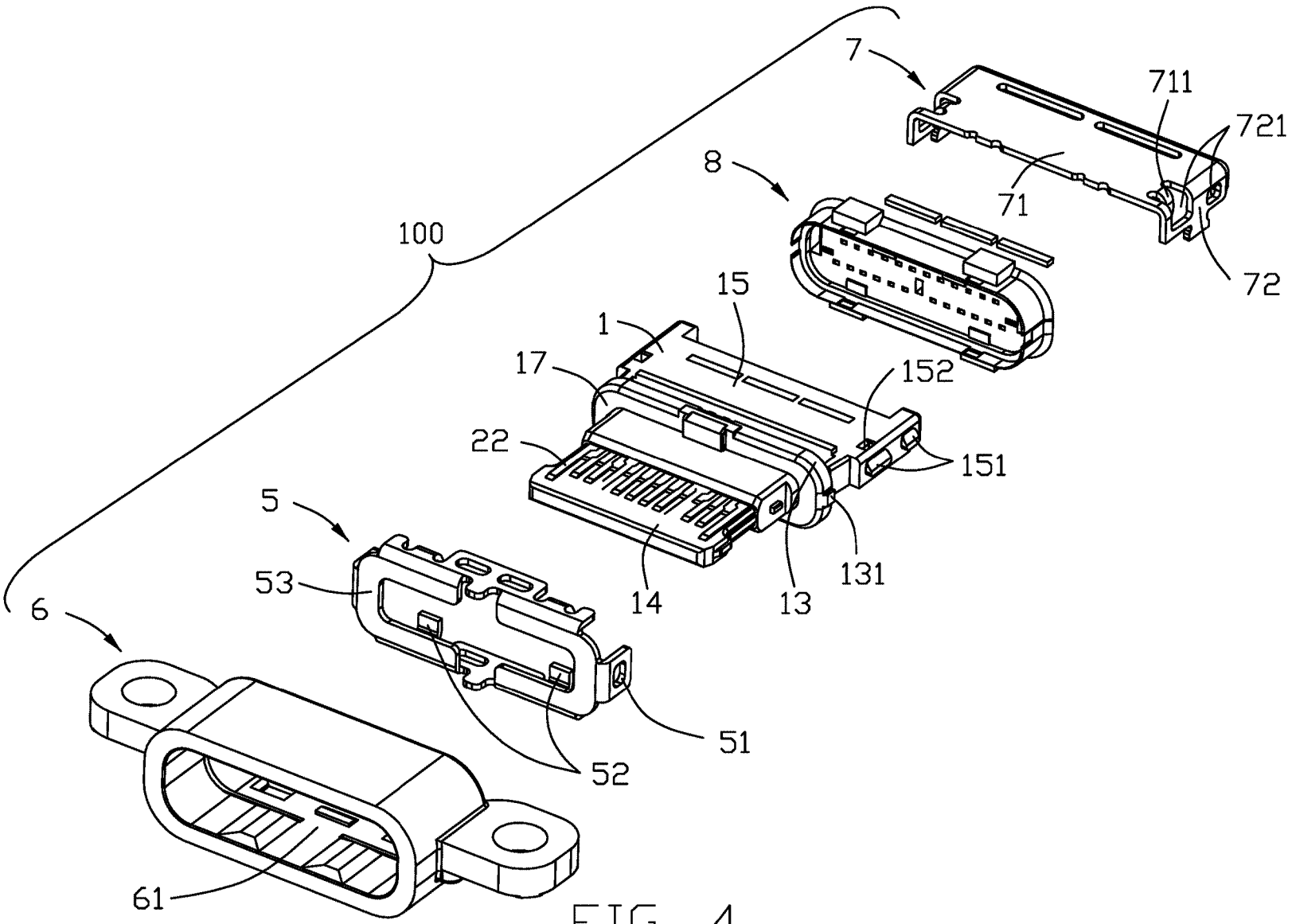
FIG. 4 is an exploded view of the electrical connector in FIG. 1.
Figure 4A:
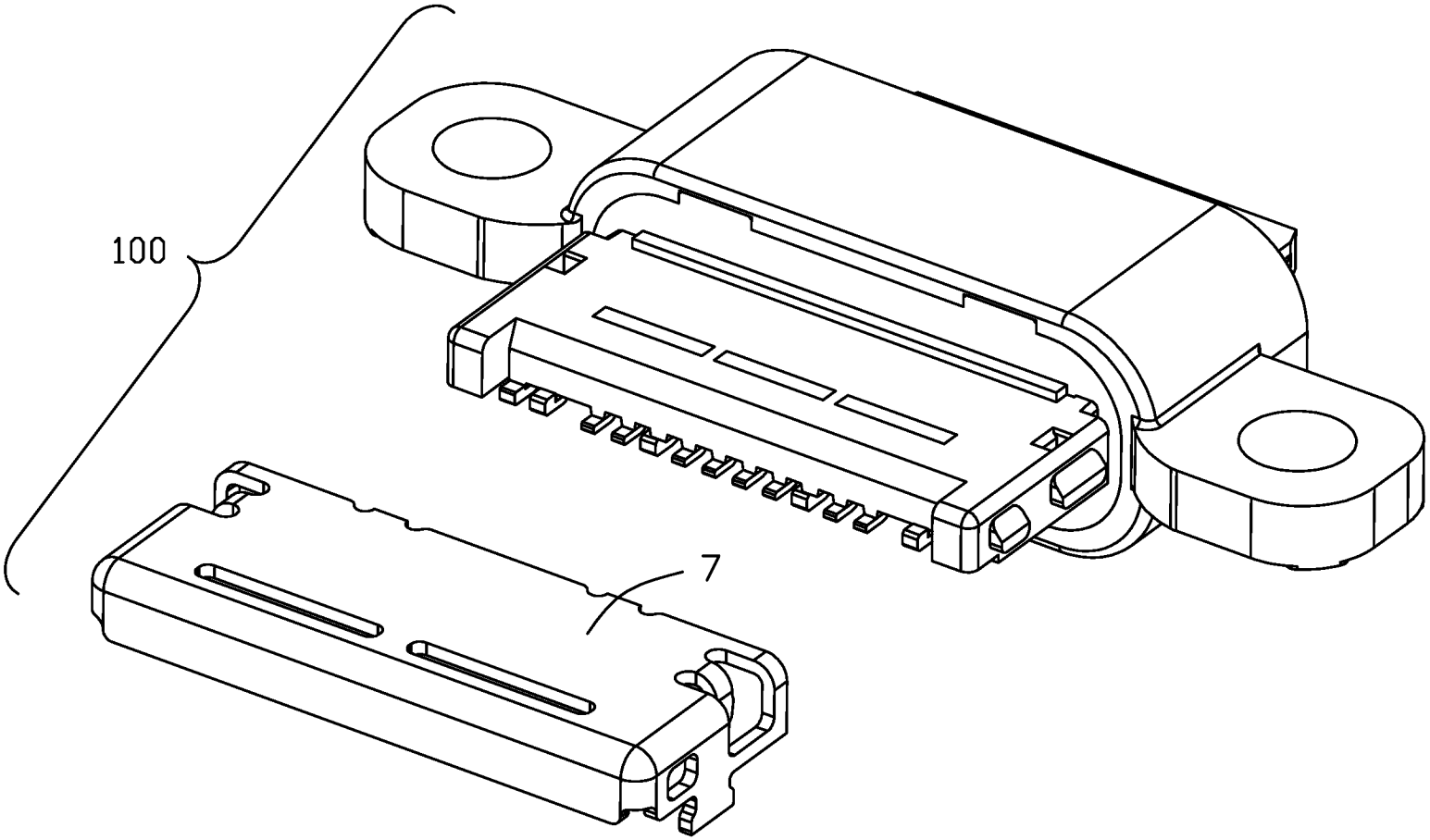
FIG. 4(A) is an exploded view of the electrical connector in FIG. 1 wherein the rear shell is removed away from the remaining parts.
Figure 4B:
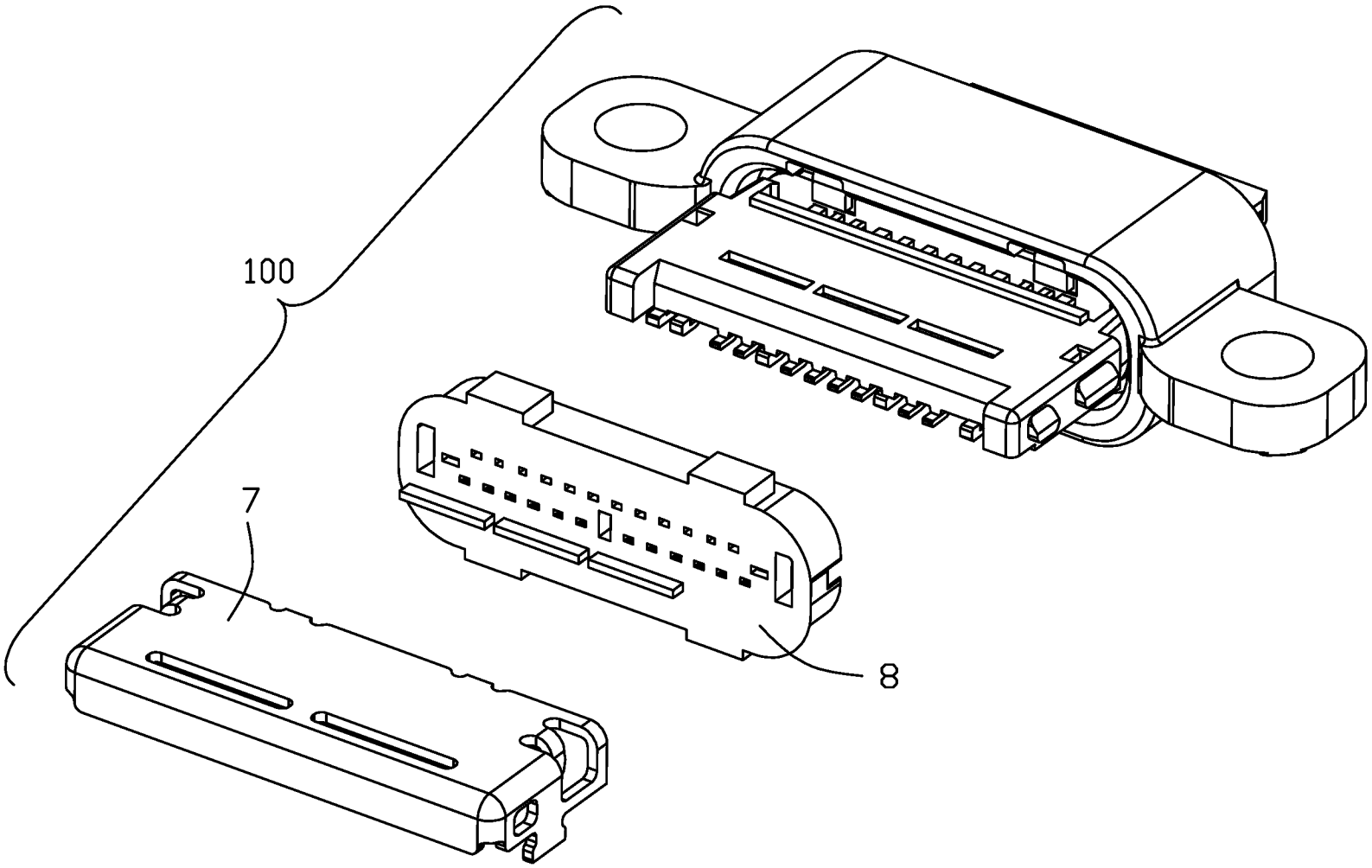
FIG. 4(B) is an exploded view of the electrical connector in FIG. 1 wherein both the rear shell and the rear sealing member are removed away from the remaining parts.
Figure 5:
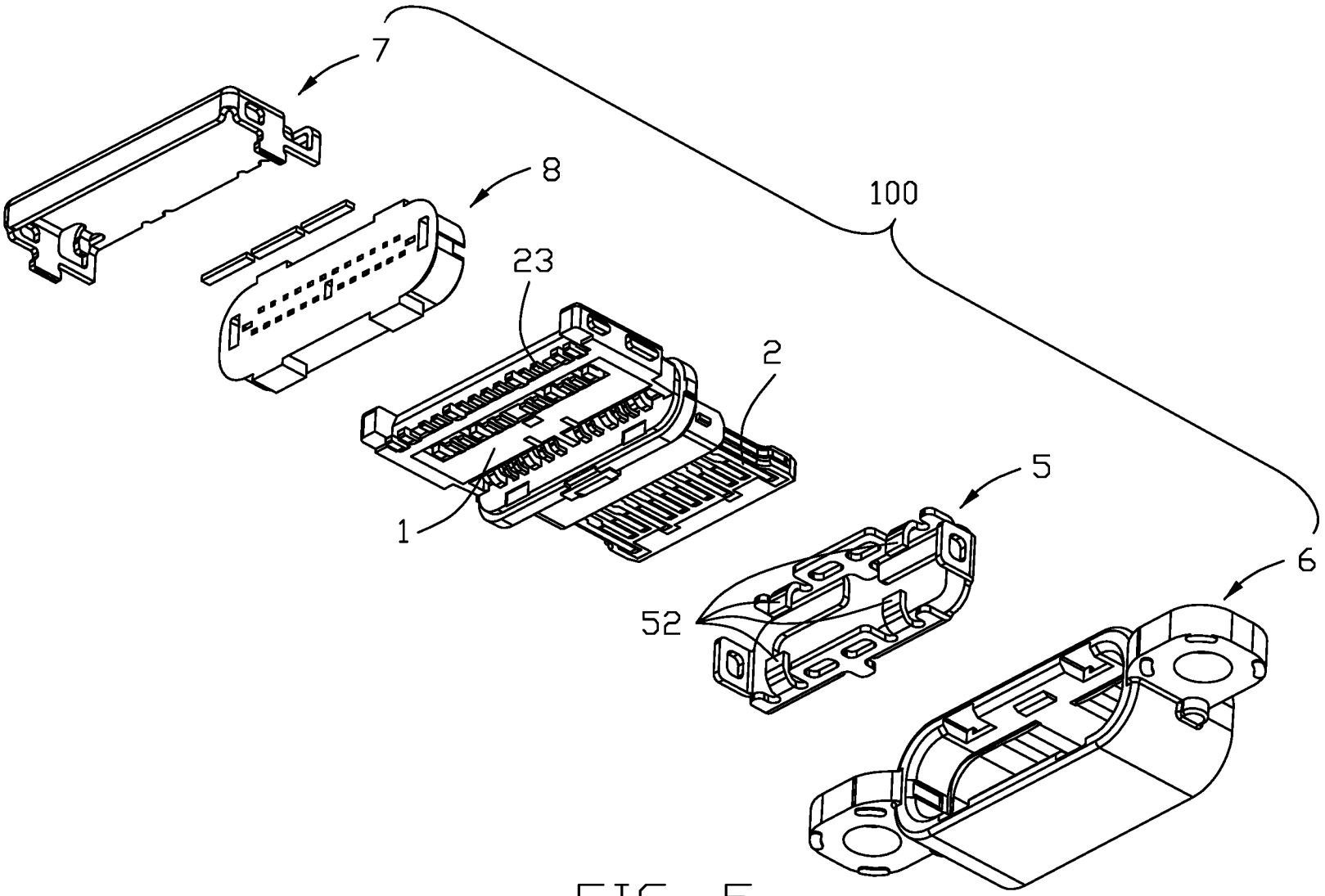
FIG. 5 is an exploded view of the electrical connector in FIG. 2.
Figure 13:
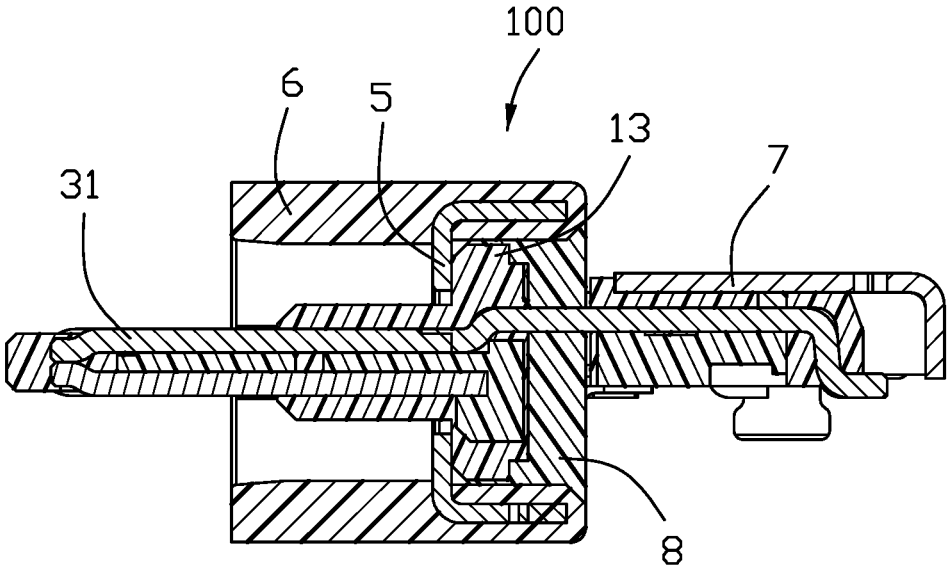
FIG. 13 is a cross-sectional view of the electrical connector taken along line 13-13 in FIG. 1.
Figure 13A:
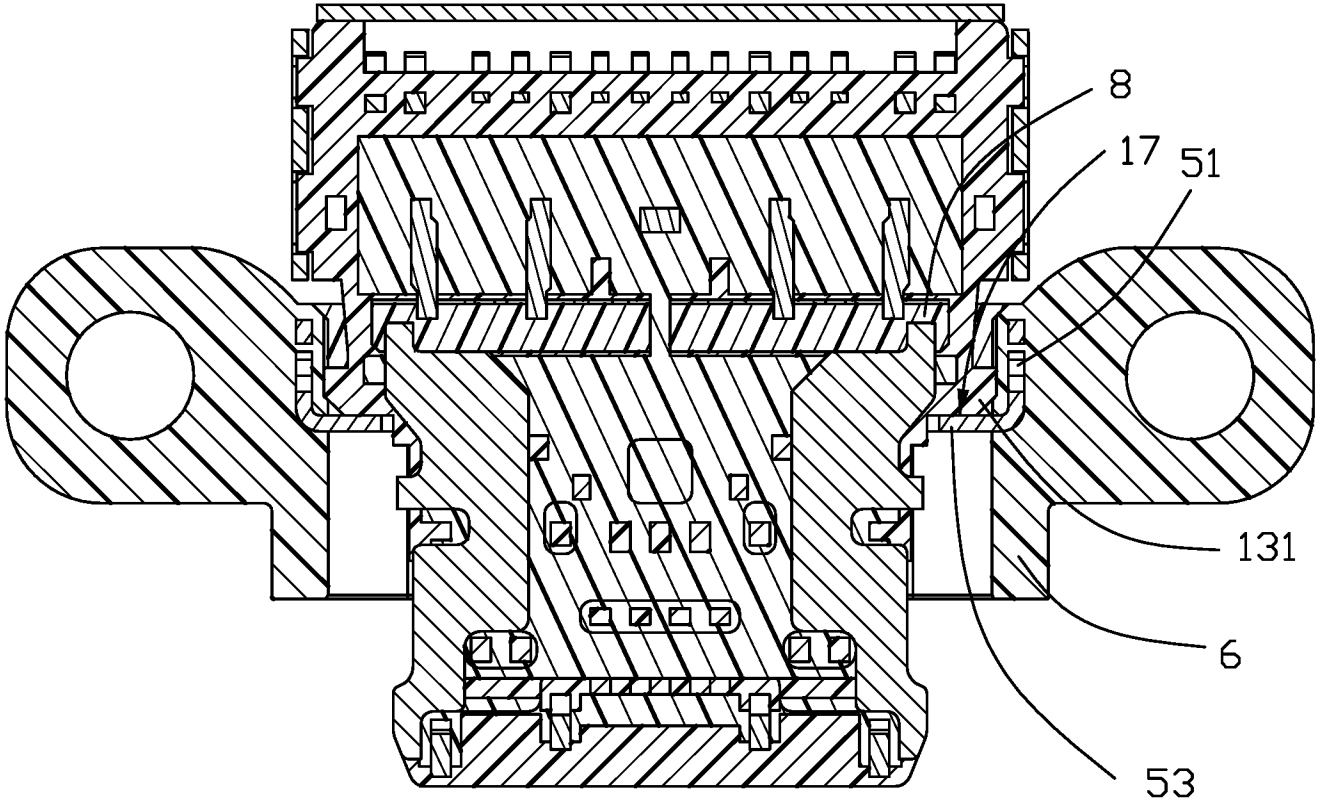
Figure 14:
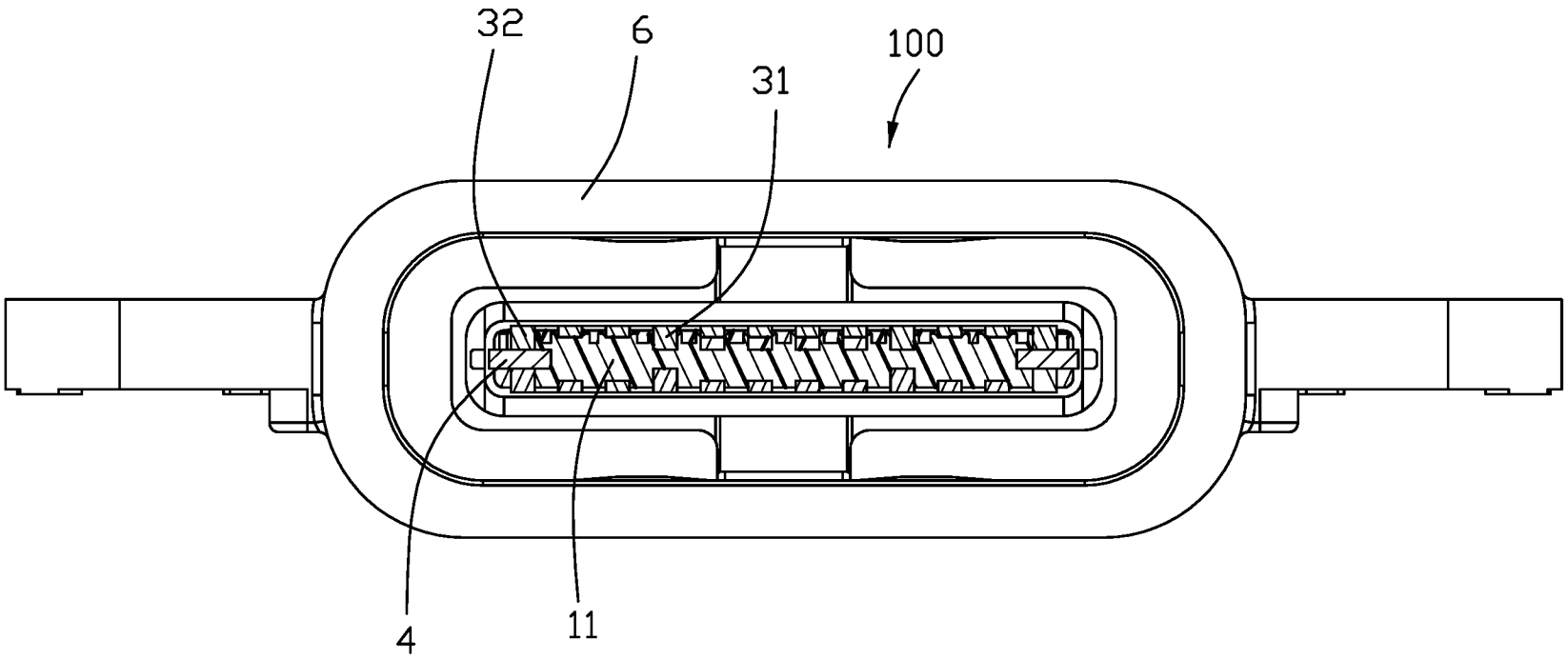
FIG. 14 is a cross-sectional view of the electrical connector taken along line 14-14 in FIG. 1.
Figure 15:
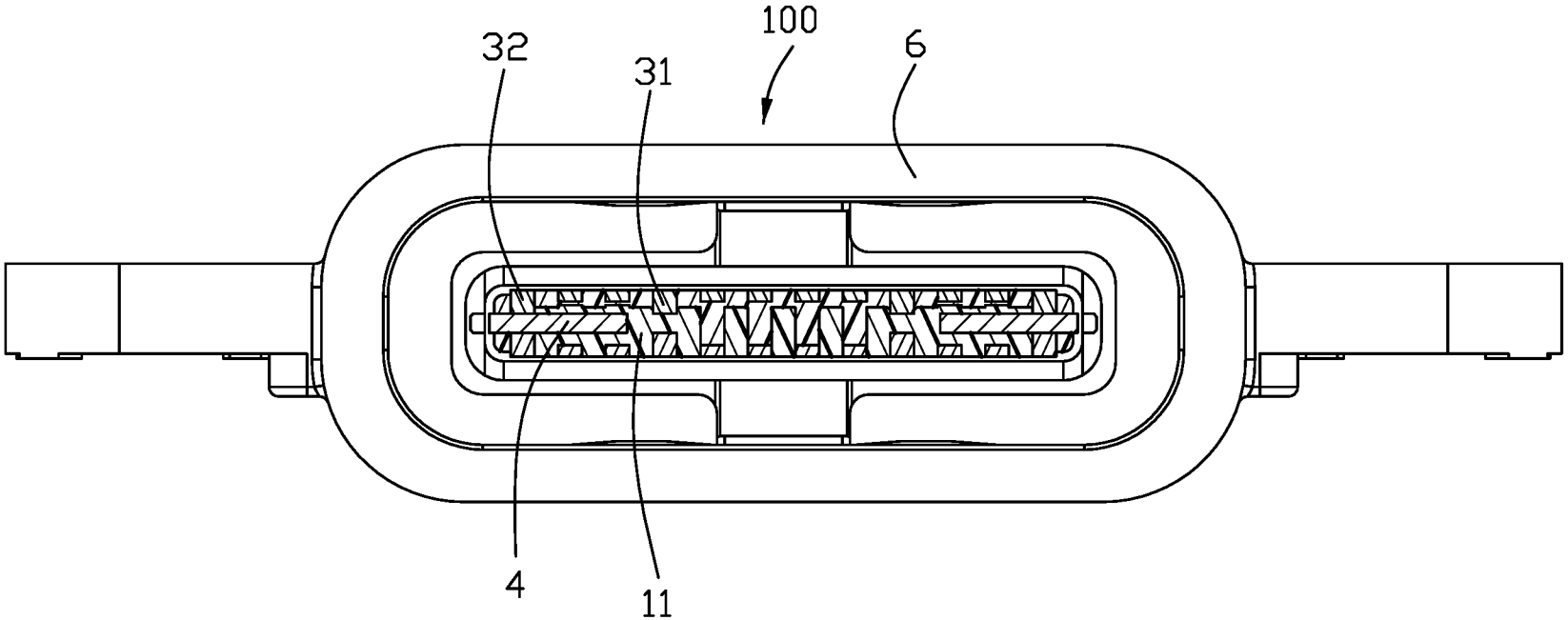
FIG. 15 is a cross-sectional view of the electrical connector taken along line 15-15 in FIG. 1.

Referring to FIGS. 4-5 and 16, in the contact module or product made, the first insulator 11 and the second insulator 12 constitute the insulative housing 1. The insulative housing 1 has a base 13, a front tongue 14, and a rear mount 15. The grounding ring 5 has a pair of securing latches 51. The plastic cover 6 has a receiving space for accommodating the insulative housing 1, which forms a mating chamber 610 for receiving a complementary connector. In this embodiment, the plastic over 6 is firstly integrally formed with the grounding ring 5 via n insert-molding process as understandably shown in FIGS. 12 and 13 wherein the securing legs 51 is embedded within the plastic cover 6. On one hand, the plastic cover 6 with the associated grounding ring 5 is assembled to the assembled contact module by bending the securing legs 52 from a horizontal position to a vertical position to abut against a rearward face 19 of the insulative housing 1 so as to prevent forward movement of the plastic cover 6 with regard to the finalized contact module, as understandably disclosed in FIG. 5. On the other hand, the vertical plate 53 of the grounding ring 5 abuts against a forward face 17 of the housing 1 so as to prevent further rearward movement of the plastic cover 6 with regard to the finalized contact module, as understandably disclosed in FIGS. 4 and 13(A). Therefore, the plastic cover 6 with the associated grounding ring 5 is reliably secured to the finalized contact module. Notably, The rear shell 7 has a planar part 71 with fingers 711 for holes 152 of the rear mount 15 and a pair of side parts 72 with holes 721 for features 151 of the rear mount 15.

By employing a thicker contact carrier for forming the power contacts in order to conduct large current as well as by molding the thicker power contacts carried by a first contact carrier with other thinner signal contacts carried by a second contact carrier, and optionally with the middle shielding plate carried by a third carrier, in a same molding operation, the manufacturing process is more efficient.

Figure 18:
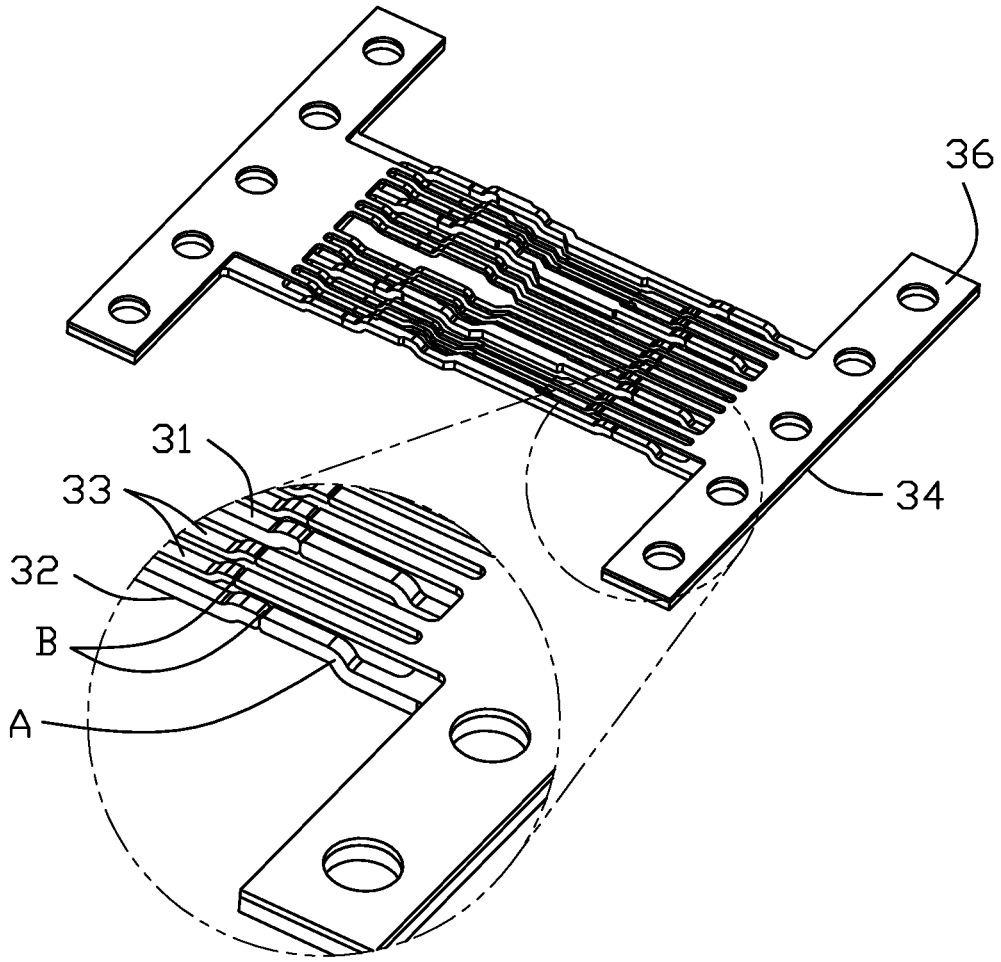
FIG. 18 shows the row of contacts from the first contact carrier and the row of contacts from the second contact carrier in a combined state.
Figure 19:
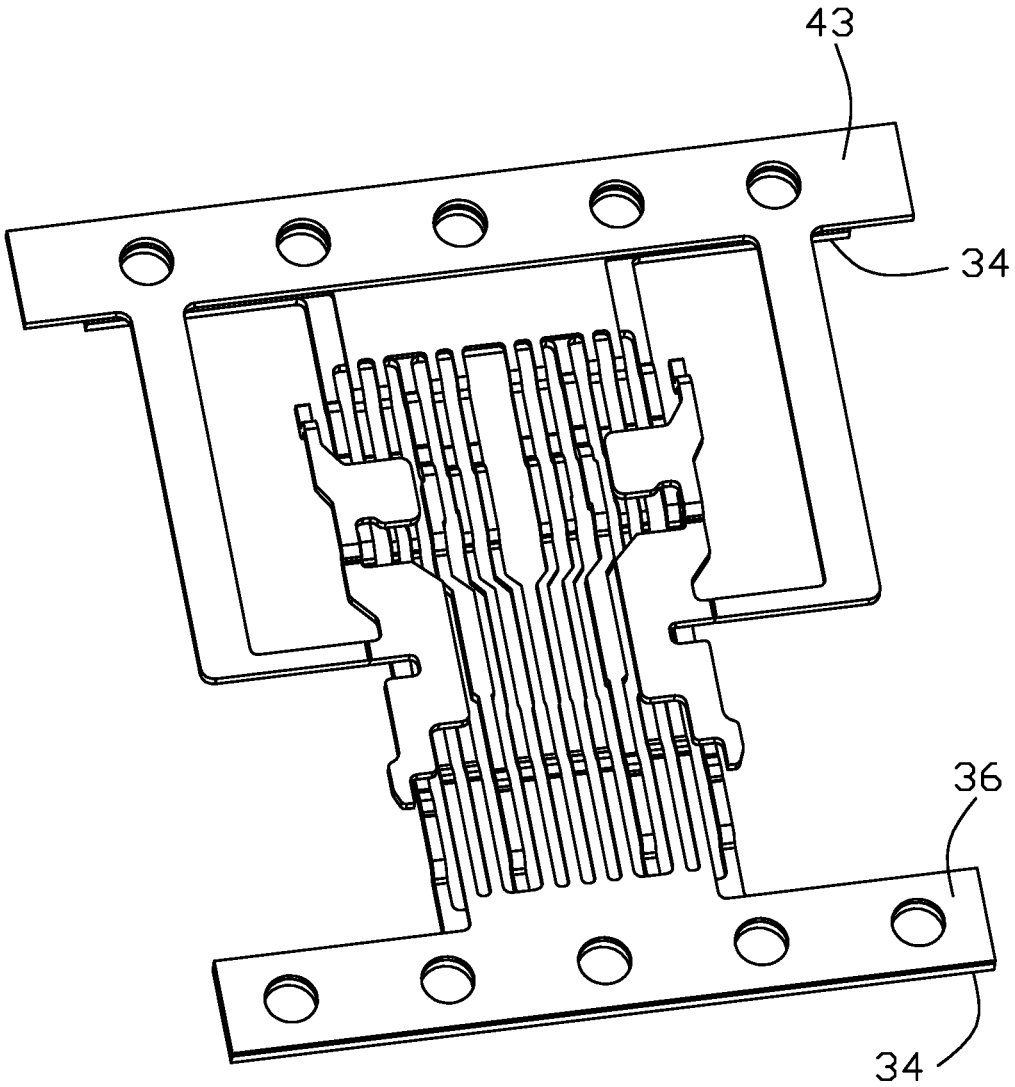
FIG. 19 shows the row of contacts from the first contact carrier, the row of contacts from the second contact carrier, and the middle shielding plate from another carrier in a combined state.
Figure 20:
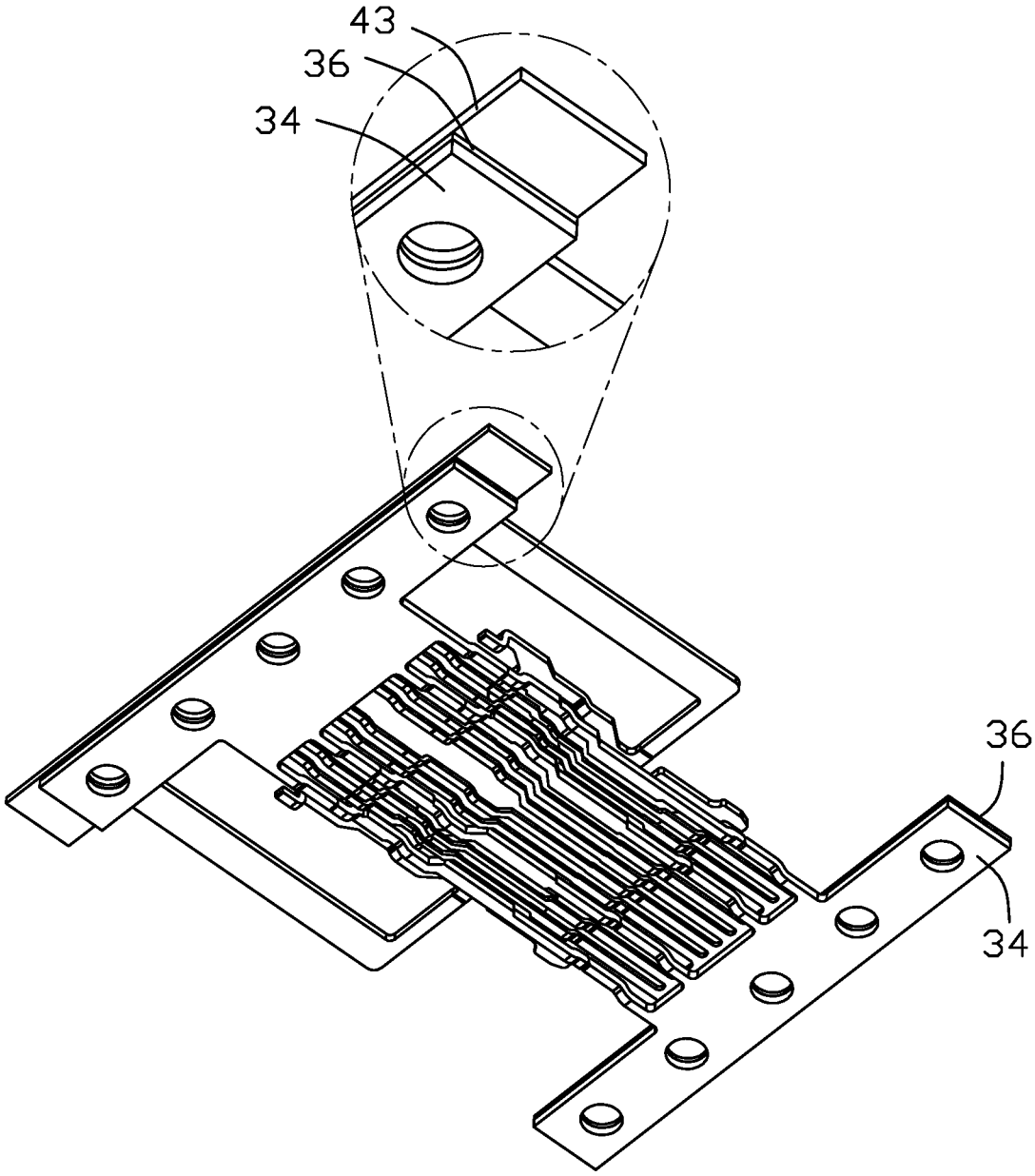
FIG. 20 is a view similar to FIG. 19 but from another perspective.

Referring to FIGS. 16-20, since the contacting portions 22 of all contacts 31, 32, 33 in the same row are required to be coplanar, and further in view of the slightly forwardly positioned front bent ends of the power and ground contacts, the stacked carriers 34 and 36 of different thickness need be adjusted accordingly to have transitions A as shown in FIG. 18. Also, in the embodiment shown, when stacked during manufacturing, the thicker carrier 34 is placed distal from the third carrier 43 while the thinner carrier 36 is placed proximal to the third carrier 43. In addition, the three carriers 34, 36, and 43 are of different thickness and moreover the carrier 43 is made of a material different from the carriers 34 and 36, though it is also contemplated the carrier 43 may be of same thickness as the first carrier 34. Furthermore, in other embodiments, the ground contacts may not need be thick and therefore need not be formed on the same contact carrier as the power contacts.

What is claimed is:

1. A method of making an electrical connector having a contact module which includes a tongue with two opposite surfaces and a first and second rows of contacts with contacting portions exposed to the two opposite surfaces of the tongue, characterized by the steps of:

forming a row of contacts from a first contact carrier of a first thickness;

forming a row of contacts from a second contact carrier of a second thickness less than the first thickness;

stacking the first contact carrier and the second contact carrier with each other; and molding the row of contacts from the first contact carrier and the row of contacts from the second contact carrier to form the first row of contacts.

2. The method as claimed in claim 1, further comprising a step of forming a shielding plate from another contact carrier, and wherein the step of molding includes molding the row of contacts from the first contact carrier, the row of contacts from the second contact carrier, and the shielding plate to form a semi-finished contact module.

3. The method as claimed in claim 1, further comprising a step of assembling a row of contacts linked with a third contact carrier and a row of contacts linked with a fourth contact carrier upon the semi-finished contact module.

4. The method as claimed in claim 3, further comprising a step of insert-molding both the row of contacts linked with the third contact carrier and the row of contacts linked with the fourth contact carrier with the semi-finished contact module to complete a finalized contact module.

5. The method as claimed in claim 4, wherein both the first contact carrier and the second contact carrier are removed from the semi-finished contact module before the step of insert-molding.

6. The method as claimed in claim 5, further including a step of integrally forming a metallic grounding ring within a plastic cover defining a mating chamber, a step of assembling the plastic cover to the finalized contact module along a front-to-back direction until a vertical plane of the grounding ring abuts against a forward face of the finalized contact module, and a step of bending each of a plurality of securing legs of the metallic grounding ring from a horizontal position to a vertical position to abut against a rearward face of the finalized contact module so as to retain the plastic cover with regard to the finalized contact module.

7. The method as claimed in claim 1, wherein during the step of molding contacting portions of all the contacts are located in a same plane.

8. A method of making an electrical connector having a contact module which includes a tongue with two opposite exposed upper and lower surfaces, comprising steps of:

forming a lower row of thick contacts linked with a lower thick contact carrier;

forming a lower row of thin contacts linked with a lower thin contact carrier;

forming a metallic shielding plate linked with a middle carrier; and molding the lower row of thick contacts, the lower row of thin contacts and the metallic shielding plate together with a first insulator via a first stage insert-molding process to form a semi-finished contact module; wherein contacting portions of the lower row of thick contacts and those of the lower row of thin contacts are coplanar with each other around the lower surface of the tongue but both offset from the shielding plate in a vertical direction, while the lower thick contact carrier, the lower thin contact carrier and the middle carrier are offset from one another in the vertical direction.

9. The method as claimed in claim 8, further include steps of:

forming an upper row of thin contacts linked with an upper thin contact carrier;

forming an upper row of thick contacts linked with an upper thick contact carrier;

molding the semi-finished contact module, the upper row of thin contacts and the upper row of thick contacts together with a second insulator via a second stage insert-molding process to form a finalized contacts module; wherein contacting portions of the upper row of thin contacts ad those of the upper row of thick contacts are coplanar with each other around the upper surface of the tongue but both offset from both the shielding plate and those of the lower row of thick contacts and thin contacts, while the upper thin contact carrier, the upper thick contact carrier and the middle carrier are offset from one another in the vertical direction.

10. The method as claimed in claim 9, wherein the middle carrier is located above the lower thin contact carrier and the lower thick contact carrier while below the upper thin contact carrier and the upper thick contact carrier in the vertical direction.

11. The method as claimed in claim 9, further including steps of removing the lower thin contact carrier, the lower thick contact carrier, the middle carrier, the upper thin contact carrier and the upper thick contact carrier.

12. The method as claimed in claim 11, further including steps of forming a plastic cover with a metallic grounding ring embedded therein via an insert-molding process, and inserting the finalized contact module into a chamber of the plastic cover.

13. The method as claimed in claim 12, wherein the grounding ring includes a vertical plate against which the contact module abuts so as to restrict further forward movement of the contact module with regard to the plastic cover.

14. The method as claimed in claim 12, further including a step of bending securing legs to abut against the contact module after the contact module is assembled into the plastic cover so as to restrict rearward movement of the contact module with regard to the plastic cover.

15. The method as claimed in claim 12, further including a step of applying a rear sealing member into a rear side of the plastic cover to surround the contact module.

16. The method as claimed in claim 15, further including a step of assembling a metallic rear shell upon a rear portion of the contact module behind the rear sealing member.

17. The method as claimed in claim 11, wherein before removing from corresponding contacts, the upper thick contact carrier is higher than the upper thin contact carrier while the lower thick contact carrier is lower than the lower thin contact carrier in the vertical direction.

* * * * *